United States Patent [19]

Caron

[11] 4,064,586

[45] Dec. 27, 1977

[54] FILTER SYSTEM FOR SWIMMING POOL CLEANING MACHINES

[75] Inventor: Marshall J. Caron, Boca Raton, Fla.

[73] Assignee: Florida Machine of Boca Raton, Boca Raton, Fla.

[21] Appl. No.: 654,568

[22] Filed: Feb. 2, 1976

[51] Int. Cl.[2] ..... E04H 3/20

[52] U.S. Cl. ..... 15/1.7; 210/94; 210/169; 210/306

[58] Field of Search ..... 210/94, 169, 306; 15/1.7, 353

[56] References Cited

U.S. PATENT DOCUMENTS

| | | | |
|---|---|---|---|
| 3,078,998 | 2/1963 | Blumenfeld | 210/169 |
| 3,343,199 | 9/1967 | Nolte | 15/353 X |
| 3,481,470 | 12/1969 | Valois | 15/1.7 X |
| 3,667,611 | 6/1972 | Pansmi | 210/163 |
| 3,676,885 | 7/1972 | Wyle | 15/1.7 |
| 3,688,908 | 9/1972 | Myers | 210/169 |
| 3,755,843 | 9/1973 | Gocrtzam | 15/1.7 |
| 3,839,749 | 10/1974 | Blumenfeld et al. | 210/169 |
| 3,868,739 | 3/1975 | Harjrave | 15/1.7 |

*Primary Examiner*—Theodore A. Granger
*Attorney, Agent, or Firm*—Zarley, McKee, Thomte & Voorhees

[57] ABSTRACT

A filter system for swimming pool cleaning machines comprising a filter tank cover secured to the pool cleaner and having a debris trap removably mounted on the rearward end thereof. The debris trap has an inlet end in communication with the water discharge conduit of the swimming pool cleaner. A flexible filter valve is positioned in the debris trap for normally closing the inlet end but which is opened by flow through the water discharge conduit. The discharge end of the debris trap comprises a plurality of spaced-apart ports having vertically disposed baffles positioned therebetween which prevent debris from sealing the openings. The transparent debris trap cover is removably mounted on the rearward end of the debris trap. A pair of filter tanks are removably mounted on the forward end of the filter tank cover and have filters positioned therein. The outlet end of the debris trap is in communication with the interiors of the filter tanks. The filter tank cover is provided with a pair of spaced-apart water discharge openings formed therein which communicate with the rearward ends of the filter tanks to permit the clean water to be discharged therefrom. Means is provided on the rearward side of the filter tank cover to cause the discharging clean water to be directed upwardly away from the pool bottom.

9 Claims, 9 Drawing Figures

FILTER SYSTEM FOR SWIMMING POOL CLEANING MACHINES

BACKGROUND OF THE INVENTION

This invention relates to a filter system for swimming pool cleaning machines and more particularly to a filter system for swimming pool cleaning machines which is easy to clean.

This invention has been assigned to Florida Machine of Boca Raton which is the owner of U.S. Pat. No. 3,688,908. The filter device of U.S. Pat, No. 3,688,908 was intended to improve the cleaning operation of the swimming pool cleaner described in U.S. Pat. No. 3,551,930. The filter device of U.S. Pat. No. 3,688,908 employed a filter which truely filtered all dirt, dust and any particles larger than 20 microns and did not rely on the central filtering system already installed in a majority of the pools. However, it has been found that where large amounts of debris such as grass, leaves, pine needles, etc. are present on the pool bottom, the filter rapidly becomes clogged which requires that the filter be removed for cleaning. This cleaning process might have to be repeated three or four times in the first hour of cleaning a dirty pool. If the clogged filter is not cleaned, the machine motor can easily become overheated causing serious damage thereto.

Therefore, it is a principal object of the invention to provide an improved filter system for swimming pool cleaning machines.

A further object of the invention is to provide a filter system for swimming pool cleaning machines which includes an easily removable debris trap which traps the larger particles of debris such as grass, pine needles, leaves, etc.

A further object of the invention is to provide a filter system for swimming pool cleaning machines including means for increasing the traction of the swimming pool cleaner.

A still further object of the invention is to provide a filter system for swimming pool cleaning machines which is easier to clean than existing devices.

A further object of the invention is to provide a filter system for swimming pool cleaning machines which reduces the possibility of overheating of the pool cleaner motor.

A still further object of the invention is to provide a filter system for swimming pool cleaning machines which is centrally positioned with respect to the pool cleaner to prevent the filter from scratching the pool walls, stairs, etc.

A still further object of the invention is to provide a filter system for swimming pool cleaning machines which is ecomomical to manufacture, durable in use and refined in appearance.

DESCRIPTION OF THE PREFERRED EMBODIMENT

Figure 1:
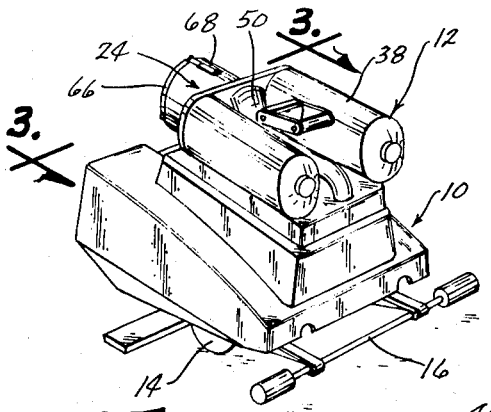
FIG. 1 is a perspective view of a swimming pool cleaning machine having the filter device of this invention mounted thereon.

The numeral 10 refers generally to a swimming pool cleaner such as disclosed in U.S. Pat. Nos. 3,439,368 and 3,551,930. It is to the cleaner 10 that the filter 12 of this invention is attached as seen in FIG. 1. Cleaner 10 is a random type cleaner having powered wheels 14 and a sensing means 16 at the forward end thereof for controlling the operation of the wheels at each side thereof. Cleaner 10 includes a pump means or a vacuum means (not shown) which is adapted to pick up the dirt and debris particles 18 from the bottom 20 of the pool. The particles are drawn upwardly through the device and are discharged from the rearward end of an exhaust pipe or water discharge conduit 22 together with the water passing therethrough.

Figure 3:
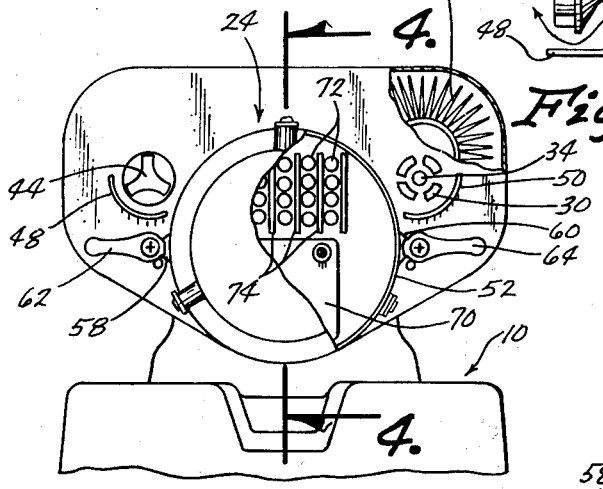
FIG. 3 is an enlarged partial sectional view seen on lines 3—3 of FIG. 1.

Filter 12 generally comprises a filter tank cover 24 which is secured to the pool cleaner by any convenient means such as illustrated in the drawings. Filter tank cover 24 includes an opening 26 provided at the lower end thereof and opening 28 provided at the upper central portion thereof. Discharge openings 30 and 32 are formed in filter tank cover 24 and have the segmented configuration as illustrated in FIG. 3. An opening 34 extends through the cover 24 between the segments of opening 30 and between the segments of opening 32 as seen in FIG. 3 and which are each adapted to receive a bolt 36 extending from filter tanks 38. A pair of the filter tanks 38 are mounted on the filter tank cover 24 in the manner illustrated in the drawings. A filter 40 comprised of a paper material is positioned in each of the filter tanks 38 as illustrated in the drawings. Each of the filter tanks 38 has an inlet opening 42 intermediate the ends thereof.

Figure 8:
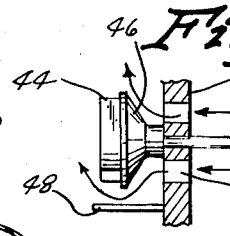
FIG. 8 is a side view illustrating the deflector knobs.

A bolt 36 extends through each of the openings 34 and has a deflecting knob 44 threadably mounted on the rearward end thereof to maintain the filter tank 38 on the cover 24. As seen in FIG. 8, knob 44 includes a forward deflecting surface 46 which is disposed at approximately a 15 degree angle relative to the rearward surface of cover 24 for a purpose to be described in more detail hereinafter. The rearward surface of cover 24 has a pair of flow deflector tabs 48 extending therefrom which are positioned adjacent the rearward side of the openings 30 and 32 and the knobs 44 as seen in the drawings. Conduit 50 extends from opening 28 to the openings 42 on filter tanks 38.

Figure 2:
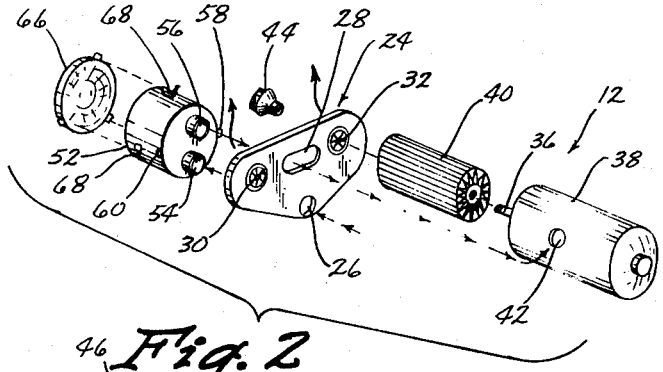
FIG. 2 is a partial exploded perspective view of the filter device of this invention.
Figure 4:
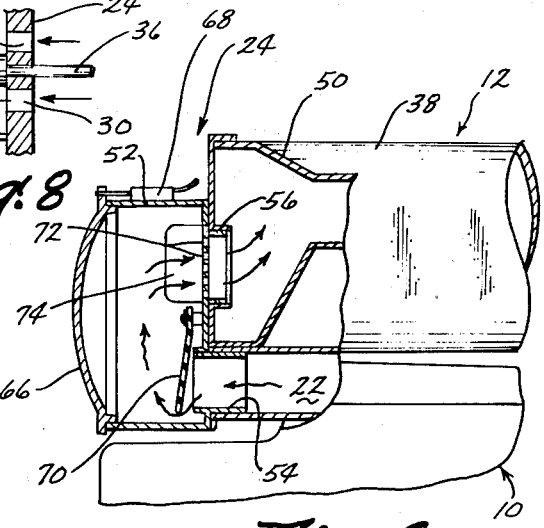
FIG. 4 is a partial sectional view seen on lines 4—4 of FIG. 3.
Figure 6:
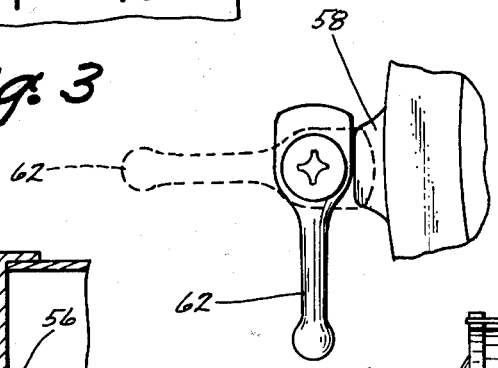
FIG. 6 is a elevational view illustrating the manner in which the debris trap is secured to the filter tank cover.

The numeral 52 refers to a debris trap which is removably mounted on cover 24. Debris trap 52 has inlet and outlet conduits 54 and 56 extending forwardly from the lower and upper ends thereof as illustrated in FIG. 2. Inlet conduit 54 extends through opening 26 of cover 24 and is received by the rearward end of water discharge conduit 22. Debris trap 22 has a pair of spaced-apart tabs 58 and 60 extending outwardly from the forward and thereof adapted to be engaged by the cam clamps 62 and 64 mounted on the rearward side of the cover 24 to provide a quick means of securing the debris trap 52 to the cover 24. The numeral 66 refers to a clear or transparent cover which is removably secured to the rearward end of debris trap 52 by clamps 68 as seen in FIG. 4.

Figure 5:
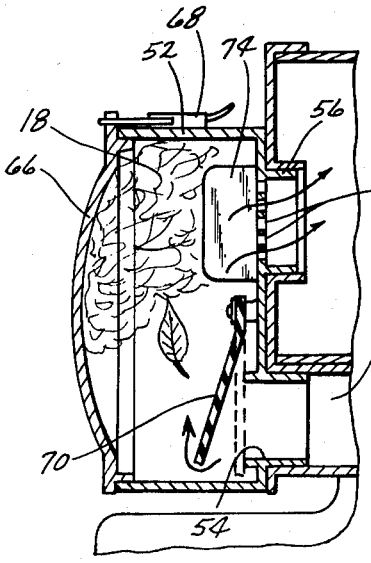
FIG. 5 is a sectional view similar to FIG. 4.
Figure 9:
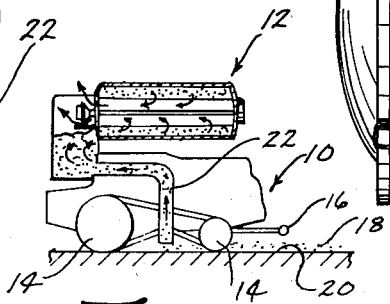
FIG. 9 is a sectional view of the apparatus of FIG. 1.
Figure 7:
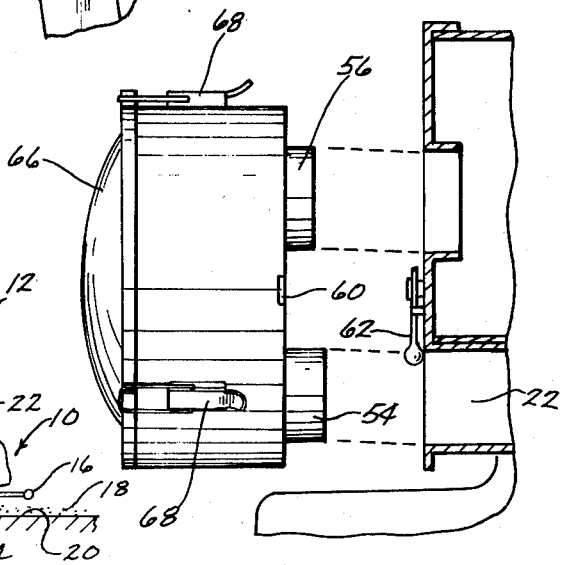
FIG. 7 is a side view illustrating the manner in which the debris trap is removed from the filter tank cover.

Flexible filter valve 70 is positioned in the interior of debris trap 52 and normally closes the conduit 54 as illustrated by broken lines in FIG. 5. When water is pumped through conduit 22, the valve 70 moves to the position illustrated by solid lines in FIG. 5. A plurality of spaced-apart ports 72 extend through the forward end of trap 52 and communicate with the outlet or discharge conduit 56. Vertically disposed and rearwardly extending baffles 74 are provided between each row of ports 72 as seen in FIGS. 3 and 5 to prevent the debris within the trap 52 from sealing or surfacing on the ports 72.

The filter device 12 is mounted on the cleaner 10 as illustrated in FIG. 1. The filter location on top of the machine distributes the weight of the filter over the rear drive axles to improve the traction of the pool cleaner. The improved traction permits the pool cleaner to climb steeper inclines and to traverse swimming pools having a slippery bottom such as those pools having an algae accumulation and in those pools having vinyl or plastic liners. The location of the filter also prevents the filter from striking and scratching the pool walls or stairs during the turning of the cleaner as it traverses the pool bottom.

Actuation of the cleaner 10 causes the pump on the cleaner to pump the debris and water from the bottom of the pool through the water discharge conduit 22 and into the interior of the debris trap 52. The water flowing into the debris trap deflects the filter valve 70 which is molded of a thermoplastic rubber. When the machine is deactivated, the filter valve 70 closes due to the gravity of the water which is above the valve 70. The closing of the filter valve 70 maintains the debris in the trap for easy removal while the machine is still in the water.

The opening of the valve 70 during the operation of the machine sends the leaves and other large debris up to the outlet portion of the trap. The vertical baffles 74 adjacent the ports 72 stops the leaves and heavy debris from surfacing or sealing the ports 72. The water and small debris particles are pumped through outlet conduit 56 into conduit 50 and thence into each of the filter tanks 38 where the filters 40 filter out the debris particles. The clean water is discharged from the tanks 38 by means of the discharge openings 30 and 32. The discharging water is deflected upwardly by the forward surfaces 46 on knobs 44 and by the flow deflector tabs 48. It is undesirable to discharge the water downwardly from the filters since such flow would agitate the dirt on the pool bottom into suspension which defeats the principal purpose of the device. The upwardly discharging water also serves to create downward pressure or thrust on the rear axle drive thereby increasing the traction of the machine.

As previously stated, the leaves and debris are maintained in the position illustrated in FIG. 5, which facilitates the observation of the debris trap becoming filled since the debris is visible through the clear cover 66. This observation is made while the machine is in operation by simply looking down in the water and viewing the same. If the debris trap appears to be packed, the machine is deactivated and the operator may simply reach down into the water and remove the debris trap by rotating the two cam clamps 62 and 64 and bringing the debris trap to poolside. The clamps 68 are then loosened to permit the interior of the trap to be rinsed and replaced on the machine without removing the entire machine from the water. This operation may have to be repeated several times with a dirty pool containing large pieces of debris such as leaves and pine needles. The fact that the larger debris particles are prevented from entering the main filters prolongs the time interval between cleaning the two cylindrical filter elements 40.

If it is necessary to clean the main filters 40, the knobs 44 are threadably removed so that the tanks 38 may be removed to permit the washing of the filters 40. The tanks 38 are reinstalled by means of the knobs 44.

I claim:

1. In combination with a submergible swimming pool cleaner having a water and debris inlet and a water discharge conduit adjacent the rearward end thereof, a debris trap having rearward, forward, upper and lower ends, said trap having an inlet end at its lower forward end which is in communication with the water discharge conduit, said trap having an outlet end adjacent its upper forward end, a transversely extending filter tank cover secured to said cleaner, said cover having rearward and forward sides, upper and lower ends and opposite ends, said cover having a water discharge opening formed therein which is in communication with the debris trap discharge conduit, said cover having a pair of laterally spaced discharge openings formed therein, a pair of spaced-apart and forwardly extending filter tanks having filters positioned therein, said tanks having water inlet openings formed therein which are in communication with the tank cover water discharge opening, said tanks having rearward discharge ends secured to the forward side of said cover which are in communication with the cover discharge openings, water deflector means on the rearward side of said cover adjacent said discharge openings for deflecting the discharging water in an upwardly direction, and trap means in said debris trap for preventing larger particles of debris from passing from said debris trap into said filter tanks while permitting smaller particles of debris to enter said filter tanks.

2. The combination of claim 1 wherein said trap comprises a plurality of spaced ports extending between said debris trap and said filter tanks, a baffle means provided adjacent said ports to prevent debris from sealing said ports, said baffle means comprising a plurality of spaced apart baffle members extending from said ports toward said debris trap.

3. The combination of claim 1 wherein said debris trap and filter tanks are centrally positioned on said cleaner.

4. The combination of claim 2 wherein said water deflection means comprises an arcuate deflector tab.

5. The combination of claim 4 wherein a deflector knob is positioned on the rearward end of said cover in the path of the discharging water.

6. The combination of claim 5 wherein a bolt secures each of said filter tanks to said cover, said bolts extending from said tanks through said cover, said deflector knobs being vertically mounted on the rearward ends of said bolts.

7. The combination of claim 1 wherein said debris trap has an open rearward end, and a transparent cover removably secured to said debris trap to selectively close the rearward end thereof.

8. The combination of claim 1 wherein said debris trap is removably secured to said filter tank cover.

9. The combination of claim 1 wherein a flexible valve element is positioned in said debris trap for closing said inlet end when the cleaner is deactivated to maintain the debris therein.

* * * * *